US005641021A

United States Patent [19]

Murray et al.

[11] Patent Number: 5,641,021

[45] Date of Patent: Jun. 24, 1997

[54] WELL CASING FILL APPARATUS AND METHOD

[75] Inventors: Dick A. Murray, Wilson; Henry E. Rogers; Bobby L. Sullaway, both of Duncan; Earl D. Webb, Healdton, all of Okla.

[73] Assignee: Halliburton Energy Services, Duncan, Okla.

[21] Appl. No.: 559,704

[22] Filed: Nov. 15, 1995

[51] Int. Cl.[6] ..... E21B 33/13

[52] U.S. Cl. ..... 166/291; 166/386; 166/154; 166/177.4

[58] Field of Search ..... 166/177.4, 154, 166/156, 317, 323, 334.4, 386, 291

[56] References Cited

U.S. PATENT DOCUMENTS

| | | | |
|---|---|---|---|
| 2,155,609 | 4/1939 | McClendon et al. . | |
| 2,602,510 | 7/1952 | Baker | 166/156 X |
| 2,741,314 | 4/1956 | Deters | 166/156 X |
| 2,791,279 | 5/1957 | Clark | 166/225 |
| 2,847,074 | 8/1958 | Maly et al. | 166/325 |
| 2,928,470 | 3/1960 | Baker | 166/154 |
| 2,947,363 | 8/1960 | Sackett et al. | 166/154 X |
| 2,998,075 | 8/1961 | Clark | 166/154 X |
| 3,338,311 | 8/1967 | Conrad | 166/154 |
| 3,527,297 | 9/1970 | Todd | 166/154 |
| 3,559,734 | 2/1971 | Pitts | 166/320 |
| 3,633,671 | 1/1972 | Nelson | 166/224 |
| 4,664,192 | 5/1987 | Hogarth | 166/291 |
| 4,880,058 | 11/1989 | Lindsey et al. | 166/154 X |
| 5,040,606 | 8/1991 | Hopper | 166/332 |
| 5,234,052 | 8/1993 | Coone et al. | 166/155 |

*Primary Examiner*—Roger J. Schoeppel

*Attorney, Agent, or Firm*—Craig W. Roddy; C. Clark Dougherty, Jr.

[57] ABSTRACT

Improved well casing fill apparatus and methods for filling a casing string with well bore fluid while running the string into a well bore and then cementing the casing in the well bore are provided. A well casing fill apparatus of this invention is basically comprised of a tubular housing having a well bore fluid fill port extending through a wall thereof and a closing sleeve slidably disposed in the tubular housing between an upper open position whereby the fill port is uncovered to a lower closed position whereby the closing sleeve covers the fill port. The closing sleeve includes a cementing plug landing seat thereon for receiving a cementing plug and slidably moving the closing sleeve to the closed position.

20 Claims, 3 Drawing Sheets

WELL CASING FILL APPARATUS AND METHOD

BACKGROUND OF THE INVENTION

1. Field of the Invention

The present invention relates generally to well casing fill apparatus and methods, and more particularly, to such apparatus and methods whereby a casing string is run in a well bore, filled with well bore fluid and cemented in the well bore.

2. Description of the Prior Art

In the construction of oil and gas wells, a well bore is drilled into one or more subterranean formations or zones containing oil and/or gas to be produced. The well bore is typically drilled utilizing a drilling rig which has a rotary table on its floor to rotate a pipe string during drilling and other operations.

During a well bore drilling operation, drilling fluid (also called drilling mud) is circulated through the well bore by pumping it down the drill string, through a drill bit connected thereto and upwardly back to the surface through the annulus between the walls of the well bore and the drill string. The circulation of the drilling fluid functions to lubricate the drill bit, remove cuttings from the well bore as they are produced and to exert hydrostatic pressure on pressurized fluid containing formations penetrated by the well bore whereby blow-outs are prevented.

In most instances, after the well bore is drilled, the drill string is removed and a string of casing is run into the well bore while maintaining sufficient drilling fluid in the well bore to prevent blow-outs. The term "casing string" is used herein to mean any string of pipe which is lowered into and cemented in a well bore including but not limited to surface casing, liners and the like.

During casing running operations, the casing string must be kept filled with fluid to prevent excessive fluid pressure differentials across the casing string and to prevent blow-outs. Heretofore, fluid has been added to the casing string at the surface after each additional casing joint is threadedly connected to the string and the string is lowered into the well bore. Also, well casing fill apparatus have heretofore been utilized at or near the bottom end of the casing string to allow well fluids in the well bore to enter the interior of the casing string while it is being run.

While prior casing fill apparatus have been used successfully, such apparatus have generally been complex and have not been completely reliable. That is, the fill valves associated with the apparatus have been susceptible to being accidently closed prior to completion of casing running operations without any method of reopening the valves. Further, prior casing fill apparatus cannot be used with certain types of single stage and multiple stage primary cementing equipment and/or require special procedures and apparatus for operating the fill valves. Thus, there is a continuing need for an improved casing string fill apparatus and methods of using the apparatus whereby the fill valves of the apparatus cannot be accidently closed prior to reaching total depth, the apparatus can be used with any type of single stage or multiple stage primary cementing equipment and the operation of the apparatus does not require special cementing plugs or changes in cementing practices. Further, there is a need for casing fill apparatus that can be made up in a casing string separately from the float equipment used or as an integral part of the float equipment.

SUMMARY OF THE INVENTION

The present invention provides improved well casing fill apparatus and methods which meet the needs described above and overcome the shortcomings of the prior art. The improved well casing fill apparatus of this invention is basically comprised of a tubular housing defining a longitudinal inner passage therethrough and having a well bore fluid fill port extending through a wall thereof. A closing sleeve is slidably disposed in the inner passage of the tubular housing which is slidable between an upper open position whereby the well bore fluid fill port is uncovered by the closing sleeve and a lower closed position whereby the closing sleeve covers the port. The closing sleeve includes a cementing plug landing seat thereon for receiving a cementing plug and slidably moving the closing sleeve to the closed position.

The invention also provides methods of filling a casing string with fluids contained in a well bore while running the casing string in the well bore. The methods basically comprise the steps of providing a casing fill apparatus of this invention in the casing string and then running the casing string in the well bore with the closing sleeve of the casing fill apparatus in the upper open position whereby the casing string fills with well bore fluids by way of the fill port in the apparatus. When the casing string reaches total depth in the well bore, a first cementing plug is displaced down the casing string whereby it lands on the landing seat of the closing sleeve and moves the closing sleeve to the closed position. Thereafter, a cement slurry is pumped through the first cement plug into the annulus between the casing string and the well bore, and a second cementing plug is utilized to terminate the flow of cement slurry when it lands on the first cementing plug. After placement, the cement slurry is allowed to set into a hard impermeable mass in the annulus.

It is, therefore, a general object of the present invention to provide improved well casing fill apparatus and methods.

Other objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIGS. 3–6 are a sequential series of views illustrating the use of the casing fill apparatus of FIGS. 1 and 2 for filling a casing string as it is being run into a well bore and cementing the casing string in the well bore.

DESCRIPTION OF THE PREFERRED EMBODIMENTS

Figure 1:
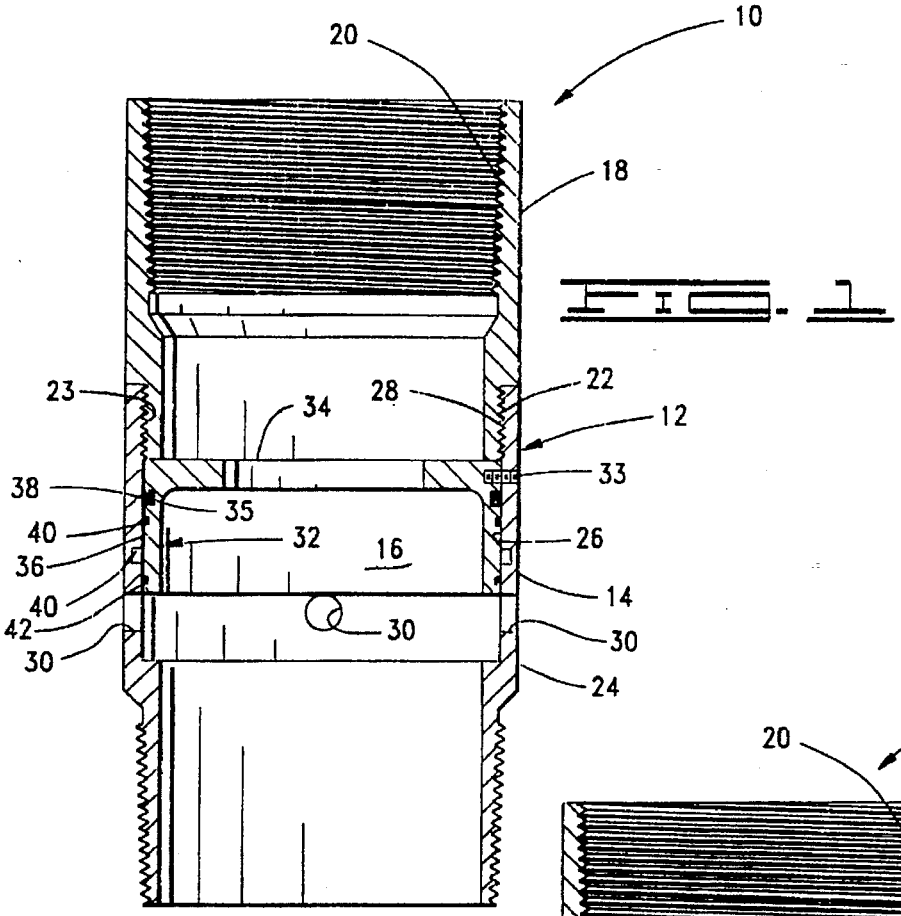
FIG. 1 is a side cross-sectional view of a well casing fill apparatus of the present invention in the open position.
Figure 2:
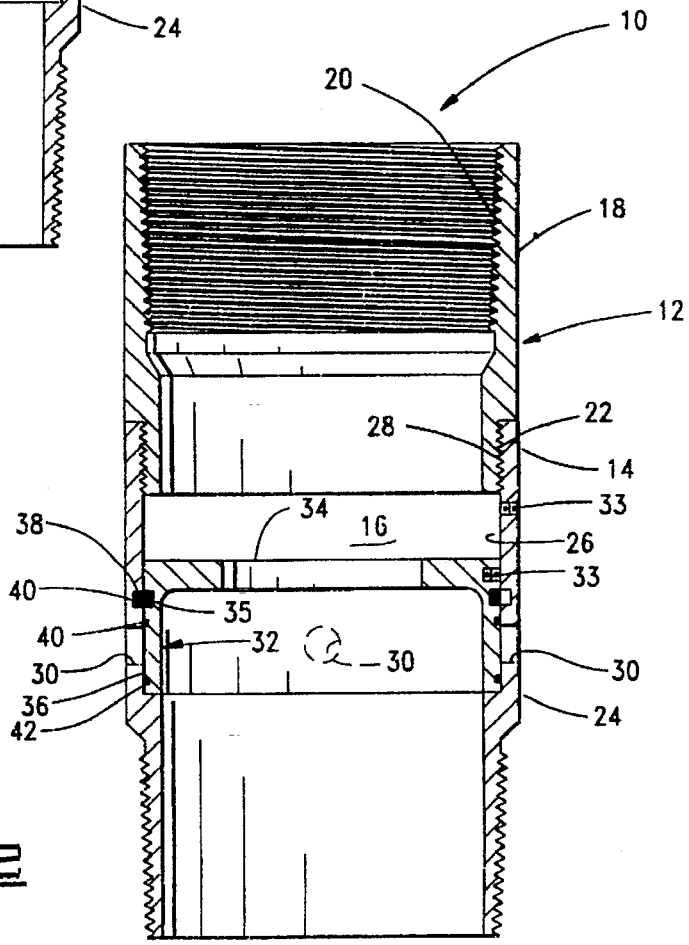
FIG. 2 is a side cross-sectional view similar to FIG. 1, but showing the casing fill apparatus in the closed position.

Referring now to the drawings and particularly to FIGS. 1 and 2, a well casing fill apparatus of the present invention is illustrated and generally designated by the numeral 10. The casing fill apparatus 10 includes a tubular housing 12 having an outer surface 14 and defining a longitudinal inner passage 16 therethrough. As illustrated in FIGS. 1 and 2, the elongated tubular housing 12 is preferably comprised of an upper tubular housing member 18 which is configured to be internally threadedly connected at the upper end 20 thereof to a casing string (not shown). The lower end 22 of the upper tubular housing member 18 includes an externally threaded recess 23 for connecting the housing member 18 to the upper end of a lower tubular housing member 24. The upper tubular housing member 24 includes an internal cylindrical recess 26, the upper end portion of which includes threads 28 for threaded connection to the upper tubular housing member 18.

One or more well bore fluid fill ports 30 are formed in the lower tubular housing member 24. Preferably, the member 24 includes four of the ports 30 equally spaced around the periphery thereof. As will be described further hereinbelow, when a casing string having the apparatus 10 therein is lowered into a well bore containing drilling and other well bore fluids, the well bore fluids enter the interior of the casing by way of the ports 30 in the apparatus 10.

A cylindrical closing sleeve 32 is slidably disposed within the internal cylindrical recess 26 of the lower tubular housing member 24. The cylindrical closing sleeve 32 is slidable between an upper open position illustrated in FIG. 1 whereby the well bore fluid fill ports 30 are uncovered by the closing sleeve 32 and a lower closed position shown in FIG. 2 whereby the closing sleeve 32 covers the ports 30.

The closing sleeve 32 includes an annular cementing plug landing seat 34 at its upper end for receiving a cementing plug and slidably moving the closing sleeve 32 to the closed position as will be described further hereinbelow. At least one shear pin 33 or other similar shear means is provided connected between the lower tubular housing member 24 and the closing sleeve 32 to hold the closing sleeve 32 in the upper open position until the shear pin 33 is sheared as will be described hereinbelow. In addition, the closing sleeve 32 includes a continuous annular groove 35 formed in the outer cylindrical surface 36 thereof. An expandable locking ring 38 is disposed in the groove 35. A groove 40 which is of complimentary size and shape to the annular groove 35 is formed in the cylindrical inner surface 26 of the lower tubular housing member 24. The annular groove 40 is positioned with respect to the groove 35 in the closing sleeve 32 whereby when the shear pin 33 is sheared and the closing sleeve 32 is moved to the closed position (FIG. 2), the grooves 35 and 40 are positioned opposite each other and the expandable locking ring 38 expands into the groove 40 thereby locking the closing sleeve 32 in the closed position.

The cylindrical outer surface 36 of the closing sleeve 32 includes two additional grooves 42 and 44 formed therein which contain O-ring sealing members for providing a seal between the outer surface 36 of the closing sleeve 32 and the inner surface 26 of the lower housing member 14. As shown in FIG. 2, when the closing sleeve 32 is in the closed position, the O-ring sealing members in the grooves 42 and 44 provide seals on both sides of the well bore fluid fill ports 30.

Referring now to FIGS. 3–6, the well casing fill apparatus 10 is shown threadedly connected in a casing string 50 which is being lowered into a well bore 54. The bottom end of the lower casing joint 51 making up the casing string 50 is threadedly connected to the upper threaded end 20 of the upper tubular housing member 18 and a conventional cementing float collar 52 is threadedly connected to the threaded lower end 53 of the lower tubular housing member 24.

Figure 3:
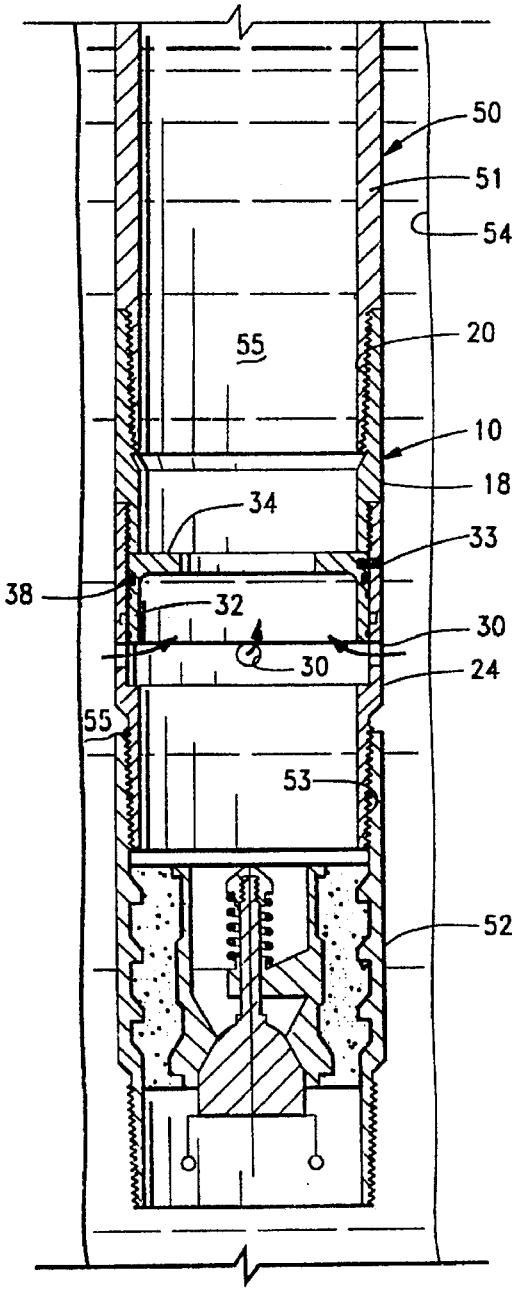

In operation of the casing fill apparatus 10, the casing string 50 is lowered in a well bore 54 which is filled with drilling and other well bore fluids 54. The closing sleeve 32 of the fill apparatus 10 is locked in the upper open position by the shear pin 33 so that the well bore fluids 55 flow through the fill ports 30 of the fill apparatus 10 into the interior of the casing string 50 as it is lowered. When the casing string 50 reaches its total depth in the well bore 54, the casing string 50 and well bore 54 are filled with the well bore fluids 55 as shown in FIG. 3.

Figure 4:
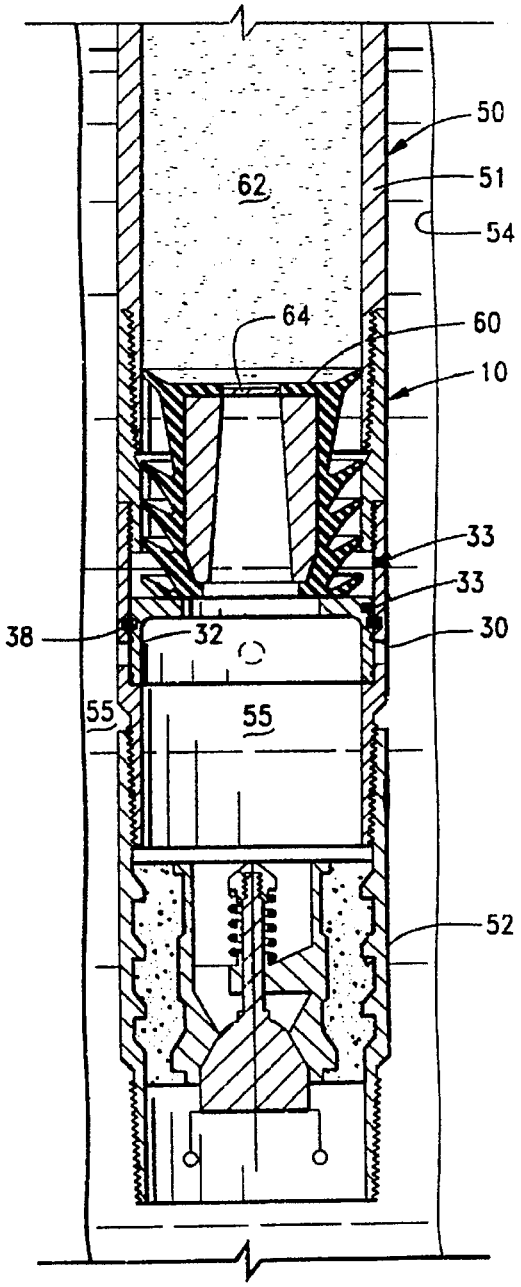

Referring now to FIG. 4, a conventional cementing plug 60 is inserted in the casing string 50 and is displaced downwardly in the casing string 50 by a cement slurry 62 until the plug 60 seats on the seating surface 34 of the closing sleeve 32. Once the cementing plug 60 has landed on the seating surface 34 of the closing sleeve 32, the fluid pressure exerted on the cementing plug 60 by the cement slurry 62 is increased whereby the downward force on the closing sleeve 32 causes the shear pin 33 to shear and the closing sleeve 32 to move to its closed position as shown in FIG. 4.

Figure 5:
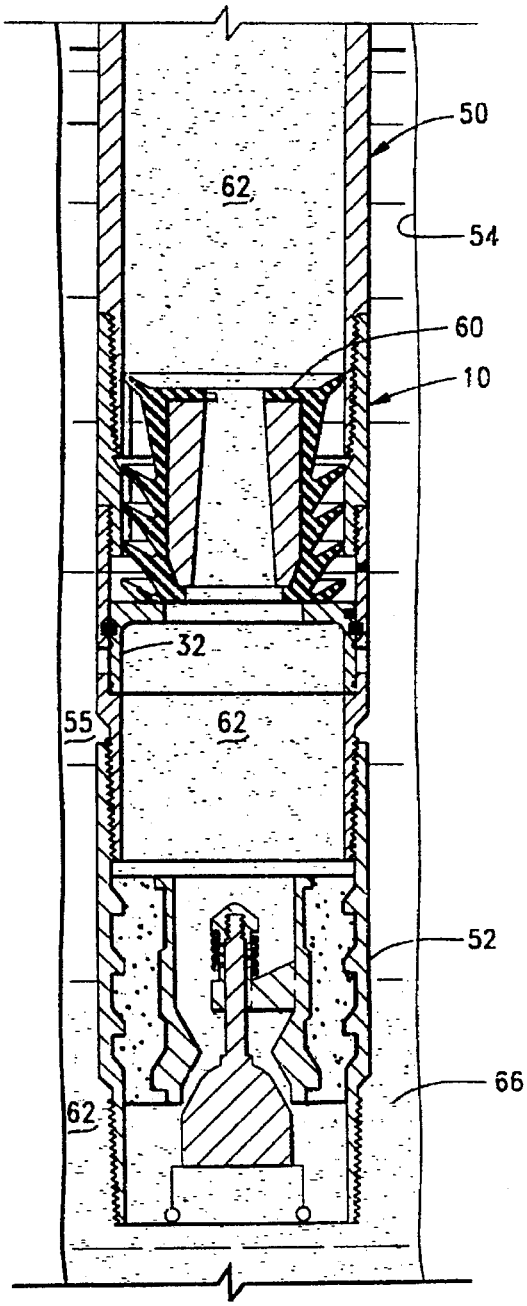
Figure 5:
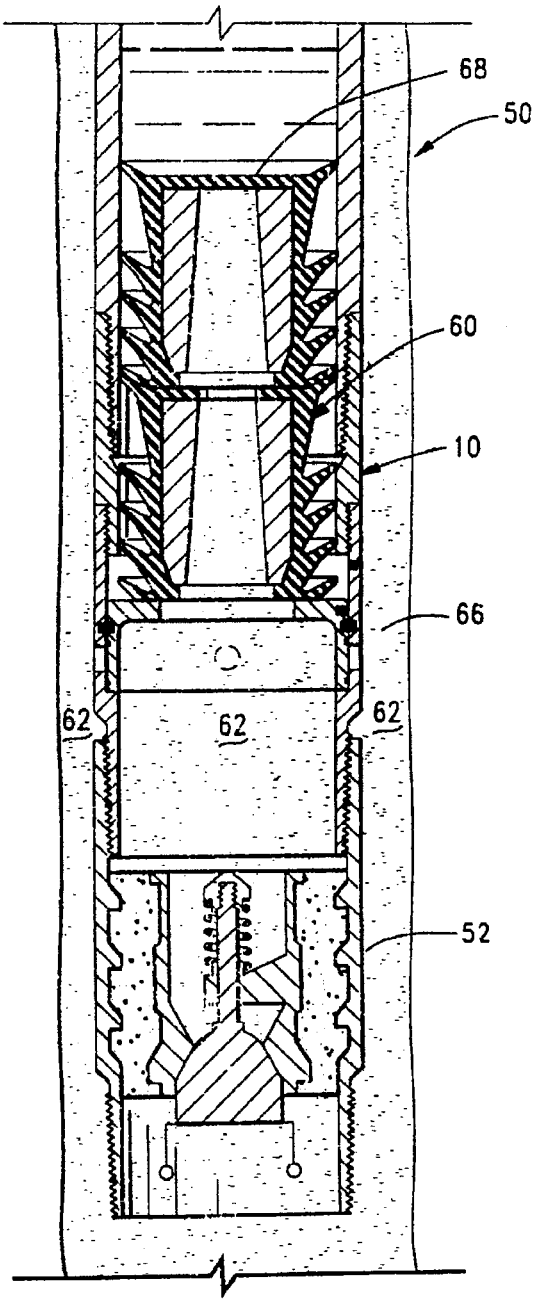

As mentioned above, when the closing sleeve 32 moves to its lower closed position, the lock ring 38 expands into the groove 40 and locks the closing sleeve 32 in the closed position. Once the ports 30 are closed by the closing sleeve, the pressure exerted by the cement slurry 62 on the cementing plug 60 is increased so that a rupture member 64 sealingly attached over an opening in the top of the cementing plug 60 ruptures and allows the cement slurry to flow through the cementing plug 60, through the fill apparatus 10 and through the float collar 52 into the annulus 66 between the casing string 50 and the walls of the well bore 54 as shown in FIG. 5.

The cement slurry 62 is displaced into the annulus 66 until the annulus is filled with the cement slurry 62 and a second cementing plug 68 inserted in the casing string 50 behind the cement slurry 62 seats on the top of the first cementing plug 60 as shown in FIG. 6. The seating of the second cementing plug 68 on top of the first cementing plug 60 shuts off the flow of the cement slurry 62 into the annulus 66. As is well understood by those skilled in the art, the float collar 52 prevents back flow into the interior of the casing string 50.

Once the annulus 66 has been filled with cement slurry, the cement slurry is allowed to set into a hard impermeable mass therein. Subsequently, if required, the cementing plugs 60 and 68, the closing sleeve seating surface 34 and the internals of the float collar 52 can be drilled out of the casing string 50.

As will now be understood by those skilled in the art, the casing fill apparatus of this invention can be inserted in a casing string at any desired threaded joint thereof or can be an integral part of a float collar or float shoe assembly. Also, the fill apparatus cannot be accidentally closed during the casing lowering operation and when the fill apparatus is closed, it is locked in the closed position. Further, the fill apparatus can be used with any type of single or multiple stage cementing equipment without requiring special procedures and/or apparatus for operating the fill apparatus.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. A well casing fill apparatus for filling a casing string with well bore fluids while running the string into a well bore comprising:

a tubular housing defining a longitudinal inner passage therethrough and having a well bore fluid fill port extending through a wall thereof; and a closing sleeve slidably disposed in said inner passage of said tubular housing and being slidable between an upper open position whereby said well bore fluid fill port is uncovered by said closing sleeve and a closed position whereby said closing sleeve covers said port, said closing sleeve including a cementing plug landing seat thereon for receiving a cementing plug and slidably moving said closing sleeve to said closed position.

2. The apparatus of claim 1 wherein said tubular housing is comprised of upper and lower housing members which are connected together at their lower and upper ends, respectively.

3. The apparatus of claim 2 wherein said upper and lower housing members are threadedly connected together and are configured to be threadedly connected in a casing string.

4. The apparatus of claim 1 which further comprises means for locking said closing sleeve in the closed position when said closing sleeve is moved thereto.

5. The apparatus of claim 1 which further comprises:

said closing sleeve having a cylindrical outer surface which slidably contacts a cylindrical inner surface of said tubular housing;

a continuous annular groove formed in said outer surface of said closing sleeve;

an expandable locking ring disposed in said groove in said closing sleeve; and a continuous annular groove formed in said inner surface of said tubular housing member positioned with respect to said groove in said closing sleeve such that when said closing sleeve is in the closed position, said grooves are positioned opposite each other and said expandable locking ring expands into said groove in said tubular housing member thereby locking said closing sleeve in the closed position.

6. The apparatus of claim 5 wherein said outer surface of said closing sleeve further includes at least one additional continuous annular groove formed therein with a sealing member for providing a seal between said outer surface of said closing sleeve and said inner surface of said tubular housing.

7. A well casing fill apparatus for filling a casing string with well bore fluids while running the string into a well bore comprising:

an upper tubular housing member configured to be internally threadedly connected at the upper end thereof to a casing string and externally threadedly connected at the lower end thereof to a lower tubular housing member;

a lower tubular housing member configured to be threadedly connected at the upper end thereof to the lower end of said upper tubular housing member, having an internal cylindrical recess extending below the lower end of said upper tubular housing member and having a well bore fluid fill port extending from the exterior thereof to said internal recess therein;

a cylindrical closing sleeve slidably disposed in said internal cylindrical recess of said lower tubular housing member and being slidable between an upper open position whereby said well bore fluid fill port is uncovered by said closing sleeve and a closed position whereby said closing sleeve covers said port, said closing sleeve including a cementing plug landing seat thereon for receiving a cementing plug and slidably moving said closing sleeve to said closed position;

a continuous annular groove formed in said outer surface of said closing sleeve;

an expandable locking ring disposed in said groove in said closing sleeve;

a continuous annular groove formed in said internal cylindrical recess of said lower tubular housing member positioned with respect to said groove in said closing sleeve such that when said closing sleeve is in the closed position, said grooves are positioned opposite each other and said expandable locking ring expands into said groove in said internal cylindrical recess of said lower tubular housing member thereby locking said closing sleeve in the closed position.

8. The apparatus of claim 7 wherein said outer surface of said closing sleeve further includes at least one additional continuous annular groove formed therein containing a sealing member for providing a seal between said outer surface of said closing sleeve and said internal cylindrical recess of said lower tubular housing member.

9. The apparatus of claim 8 wherein said closing sleeve includes a pair of said grooves containing seals, one positioned on each side of said fill port when said closing sleeve is in the closed position.

10. The apparatus of claim 9 wherein said lower tubular housing member is connected to a float collar or a float shoe.

11. A method of filling a casing string with fluids contained in a well bore while running the casing string in the well bore comprising the steps of:

providing a casing fill apparatus in said casing string comprised of a tubular housing having an outer surface and defining a longitudinal inner passage therethrough and having a well bore fluid fill port extending through a wall thereof from said outer surface to said inner passage, and a closing sleeve slidably disposed in the inner passage of said tubular housing and being slidable between an upper open position whereby said well bore fluid fill port is uncovered by said closing sleeve and a closed position whereby said closing sleeve covers said port, said closing sleeve including a cementing plug landing seat thereon for receiving a cementing plug and slidably moving said closing sleeve to said closed position;

running said casing string in said well bore with said closing sleeve of said casing fill apparatus in said upper open position whereby said casing string fills with well bore fluids by way of said fill port of said fill apparatus; and displacing a first cementing plug down said casing string whereby said cementing plug lands on said landing seat of said closing sleeve and moves said closing sleeve to said closed position.

12. The method of claim 11 wherein said casing fill apparatus includes means for locking said closing sleeve in the closed position when said closing sleeve is moved thereto.

13. The method of claim 12 which further comprises:

said closing sleeve having a cylindrical outer surface which slidably contacts a cylindrical inner surface of said tubular housing;

a continuous annular groove formed in said outer surface of said closing sleeve;

an expandable locking ring disposed in said groove in said closing sleeve; and a continuous annular groove formed in said inner surface of said tubular housing member positioned with respect to said groove in said closing sleeve such that when said closing sleeve is in the closed position, said grooves are positioned opposite each other and said expandable locking ring expands into said groove in said tubular housing member thereby locking said closing sleeve in the closed position.

14. The method of claim 13 wherein said outer surface of said closing sleeve further includes at least one additional continuous annular groove formed therein containing a sealing member for providing a seal between said outer surface of said closing sleeve and said inner surface of said tubular housing.

15. The method of claim 14 wherein said closing sleeve includes a pair of said grooves containing seals, one positioned on each side of said fill port when said closing sleeve is in the closed position.

16. The method of claim 11 wherein said first cementing plug includes a rupturable member attached thereto whereby the fluid used to displace said plug can be caused to flow through said plug after said plug lands by increasing the fluid pressure exerted on said plug to a predetermined level which ruptures said rupturable member.

17. The method of claim 16 wherein said first cementing plug is displaced down said casing string by a cement slurry pumped into said casing string behind said plug.

18. The method of claim 17 which further comprises the step of increasing the fluid pressure exerted on said first cement plug by said cement slurry to thereby rupture said rupturable member thereof and cause said cement slurry to flow into the annulus between said casing string and said well bore.

19. The method of claim 18 which further comprises the step of displacing a second cementing plug down said casing string behind said cement slurry to shut off the flow of said cement slurry when said second cement plug lands on said first cement plug.

20. The method of claim 19 which further comprises the step of allowing said cement slurry to set in said annulus.

* * * * *